US010686244B2

(12) United States Patent
Das et al.

(10) Patent No.: US 10,686,244 B2
(45) Date of Patent: Jun. 16, 2020

(54) ANTENNA HARDWARE DISPOSED ON A SUBSTRATE TO PROVIDE ENHANCED WIRELESS CONNECTIVITY

(71) Applicant: CHARTER COMMUNICATIONS OPERATING, LLC, St. Louis, MO (US)

(72) Inventors: Pratik Das, Centennial, CO (US); Diwelawatte P. Jayawardene, Aurora, CO (US); Elliott D. Hoole, Parker, CO (US); Joshua N. Sanders, Commerce City, CO (US); Manish Jindal, Plano, TX (US)

(73) Assignee: Charter Communications Operating, LLC, St. Louis, MO (US)

( * ) Notice: Subject to any disclaimer, the term of this patent is extended or adjusted under 35 U.S.C. 154(b) by 11 days.

(21) Appl. No.: 16/036,268

(22) Filed: Jul. 16, 2018

(65) Prior Publication Data

US 2020/0021006 A1 Jan. 16, 2020

(51) Int. Cl.

| | |
|---|---|
| ***H01Q 1/12*** | (2006.01) |
| ***H01Q 21/06*** | (2006.01) |
| ***H01Q 9/04*** | (2006.01) |
| ***H01Q 1/32*** | (2006.01) |

(52) U.S. Cl.

CPC ..... *H01Q 1/1271* (2013.01); *H01Q 1/3291* (2013.01); *H01Q 9/0407* (2013.01); *H01Q 21/065* (2013.01)

(58) Field of Classification Search

CPC .. H01Q 1/1271; H01Q 1/3291; H01Q 9/0407; H01Q 21/065; H01Q 25/00

See application file for complete search history.

(56) References Cited

U.S. PATENT DOCUMENTS

| | | | | |
|---|---|---|---|---|
| 2007/0149250 | A1* | 6/2007 | Crozzoli | H01Q 3/26 455/562.1 |
| 2013/0176176 | A1* | 7/2013 | Vos | H01Q 1/38 343/700 MS |
| 2014/0203960 | A1* | 7/2014 | Huang | G01S 7/034 342/175 |
| 2016/0036135 | A1* | 2/2016 | Hellinger | H01Q 3/28 342/202 |
| 2017/0365924 | A1* | 12/2017 | Topak | H01Q 3/36 |
| 2018/0090992 | A1* | 3/2018 | Shrivastava | H02J 50/50 |

FOREIGN PATENT DOCUMENTS

WO WO-2013154713 A1 * 10/2013 ..... H01Q 1/38

* cited by examiner

*Primary Examiner* — Hoang V Nguyen
(74) *Attorney, Agent, or Firm* — Armis IP Law, LLC

(57) ABSTRACT

An antenna overlay system includes antenna hardware, a communication link, and electronic circuitry disposed on a substrate. The communication link couples the electronic circuitry to the antenna hardware. During operation, the electronic circuitry in communication with the antenna hardware is operable to control transmission and reception of wireless signals in a wireless region. An adhesive layer disposed on a surface of the substrate couples the substrate to an object such as a window. In one arrangement, the window is a low-E glass windowpane that substantially attenuates wireless signals from being received by communication equipment in a building in which the windowpane is installed. The antenna overlay system provides enhanced RF signal reception and transmission.

30 Claims, 10 Drawing Sheets

ANTENNA HARDWARE DISPOSED ON A SUBSTRATE TO PROVIDE ENHANCED WIRELESS CONNECTIVITY

BACKGROUND

Use of wireless technology is becoming more common today because of respective advancements in the past several years. For example, one advancement is the number of wireless stations deployed—there are many more wireless access points, wireless base stations, etc., deployed than ever before. Such resources provided yet better wireless coverage to communication devices.

In certain instances, a user's dwelling may be physically located close enough to a wireless communication source such as a base station or wireless access point such that there is no need to pay extra fees for installation and use of a physical cable (such as a phone line, fiber cable, etc.) to receive and transmit data in the user's dwelling. Thus, increased deployment of wireless services such as base stations, wireless access points, etc., has been useful to consumers by reducing costs associated with connecting to a respective network.

BRIEF DESCRIPTION OF EMBODIMENTS

This disclosure includes the observation that buildings and other structures typically inhibit communication devices from receiving RF signals. As an example, the physical walls of a building attenuate wireless signals from passing to communication devices therein. On a positive note, however, conventional glass allows RF signals to pass through to devices operated by a subscriber. Unfortunately, the presence of low-E glass (and corresponding layer of metal material) in a respective windowpane substantially attenuates wireless signals. Thus, although low E-glass typically helps to prevent transfer of heat to save consumer costs of heating a dwelling, presence of the layer of metal material hinders reception and transmission of wireless signals through a respective windowpane. In such an instance, a wireless subscriber may be required to install and pay for use of a physical cable to receive and transmit data communications within a dwelling.

In contrast to conventional techniques, to provide improved signal reception and transmission, embodiments herein include a novel RF apparatus, method, system, etc.

For example, in one embodiment, an apparatus (such as an antenna overlay system) provides enhanced RF signal reception and transmission. The antenna overlay system includes a substrate on which components are fabricated. For example, in one embodiment, the antenna overlay system further includes antenna hardware, a communication link, and electronic circuitry disposed on the substrate. The communication link couples the electronic circuitry to the antenna hardware. During operation, the electronic circuitry in communication with the antenna hardware is operable to transmit and receive wireless signals in a wireless region.

In accordance with further embodiments, the antenna overlay system further includes an adhesive layer disposed on a surface of the substrate; the adhesive layer is operable to couple the substrate to an object such as a window in the wireless region. In one embodiment, the window is a low-E glass windowpane that substantially attenuates wireless signals from being received by a communication device in a building (residence of wireless user) in which the windowpane is installed. The antenna overlay system enhances reception and transmission of wireless signals through the windowpane.

In one embodiment, the substrate is transparent and flexible. In such an instance, the substrate will not entirely prevent seeing through a respective window to which the substrate is attached. The flexibility of the substrate enables the antenna overlay system to be attached to any surface such as a window of a house, window of an automobile, wall, etc.

In accordance with further embodiments, the antenna hardware includes one or more arrays of multiple antenna elements. Based on receipt of control signals from a beamforming management resource, the electronic circuitry is operable to: i) scan the wireless region for receipt of a first wireless signal, and ii) transmit a second wireless signal, the second wireless signal transmitted in a direction from which the first wireless signal is received. In one embodiment, the beamforming management resource (to control beamforming associated with the antenna overlay system) is disparately located with respect to the antenna overlay system and corresponding substrate.

In accordance with further embodiments, the antenna overlay system includes a rigid or flexible cable coupling the electronic circuitry on the substrate to a communication device or communication equipment disparately located with respect to the substrate and corresponding components (such as electronic circuitry, antenna hardware, etc.) disposed thereon. During operation, the electronic circuitry of the antenna overlay system is operable to convey a received RF (Radio Frequency) signal derived from a received wireless signal (as received by the antenna hardware) over a first circuit path of the flexible cable to the communication device coupled to the flexible cable. A second circuit path of the flexible cable is operable to convey, in a reverse direction, control information such as beamforming control signals from the communication device or other controller resource to the electronic circuitry in communication with the antenna hardware. In such an instance, the beamforming control signals control beamforming of transmitting and receiving wireless signals through the antenna hardware disposed on the substrate.

In still further embodiments, the antenna hardware disposed in the antenna overlay system includes a first multi-dimensional array of multiple antenna elements supporting vertical beam-forming in the wireless region; the antenna hardware includes a second multi-dimensional array of multiple antenna elements supporting horizontal beamforming in the wireless region. The one or more antenna arrays supporting beamforming enables better reception and transmission of wireless signals.

Note that the antenna hardware disposed on the substrate can be configured to support any suitable RF carrier frequencies. In one embodiment, the antenna hardware and corresponding (multi-dimensional arrays of) patch antenna elements disposed on the substrate are sized and configured to support reception and transmission of wireless signals at carrier frequencies of greater than 8 GHz. In accordance with further embodiments, different portions of the antenna hardware on the substrate of the antenna overlay system supports transmission and reception of RF energy (such as based on 5G) at so-called millimeter wavelengths.

The antenna hardware can be configured to include first antenna hardware and second antenna hardware. The first antenna hardware and second antenna hardware disposed on the substrate can be configured to support any suitable RF carrier frequencies. In one non-limiting example embodiment, the first antenna hardware is operable to transmit/receive first wireless signals at carrier frequencies greater than 8 GHz (such as for 5G communication applications); the second antenna hardware is operable to transmit/receive second wireless signals at carrier frequencies below 8 GHz (such as for LTE communication applications). Further embodiments herein include first antenna hardware operable to transmit/receive first wireless signals at carrier frequencies greater than 8 GHz and second antenna hardware operable to transmit/receive second wireless signals at carrier frequencies below 8 GHz). The antenna hardware can include any number of arrays of antenna elements to support diversity.

Further embodiments herein, as mentioned, include a flexible cable coupled to the electronic circuitry. The flexible cable can be configured to include a first circuit path to convey power to the electronic circuitry from a power supply disparately located with respect to the substrate. In accordance with further embodiments, the flexible cable includes a second circuit path to convey data, RF signal, etc., from the electronic circuitry to a (off-substrate) communication device coupled to the flexible cable.

In accordance with still further embodiments, the electronic circuitry (components) on the substrate includes: an amplifier operable to amplify electronic signals generated by the antenna hardware based on respective received RF energy. The electronic circuitry can be configured to include processing hardware operable to convey the received data, signal, etc., as an RF signal over a second circuit path of the flexible cable to a target communication device.

These and further embodiments are further discussed below.

Note that embodiments herein are useful over conventional techniques of providing wireless connectivity in a network environment. For example, the substrate (including corresponding components such as electronic circuitry, antenna hardware, communication link, etc.) as discussed herein can be adhered to an object such as a window of a physical building, automobile, etc., to provide enhanced transmission and reception of wireless signals on behalf of a subscriber therein.

Yet other embodiments herein include software programs to perform the steps and operations summarized above and disclosed in detail below. One such embodiment comprises a computer program product including a non-transitory computer-readable storage medium (i.e., any computer readable hardware storage medium) on which software instructions are encoded for subsequent execution. The instructions, when executed in a computerized device (hardware) having a processor, program and/or cause the processor (hardware) to perform the operations disclosed herein. Such arrangements are typically provided as software, code, instructions, and/or other data (e.g., data structures) arranged or encoded on a non-transitory computer readable storage medium such as an optical medium (e.g., CD-ROM), floppy disk, hard disk, memory stick, memory device, etc., or other a medium such as firmware in one or more ROM, RAM, PROM, etc., or as an Application Specific Integrated Circuit (ASIC), etc. The software or firmware or other such configurations can be installed onto a computerized device to cause the computerized device to perform the techniques explained herein.

Accordingly, embodiments herein are directed to a method, system, computer program product, etc., that supports operations as discussed herein.

One embodiment includes a computer readable storage medium and/or system having instructions stored thereon to facilitate fabrication of an antenna overlay system according to embodiments herein. The instructions, when executed by computer processor hardware, cause the computer processor hardware (such as one or more co-located or disparately processor devices) to: dispose antenna hardware on a substrate; dispose electronic circuitry on the substrate, the substrate including an adhesive layer on a respective surface to couple the substrate to an object; couple the electronic circuitry to the antenna hardware via a communication link, the electronic circuitry in communication with the antenna hardware to transmit and receive wireless signals; provide a flexible cable to couple the electronic circuitry on the substrate to communication equipment disparately located with respect to the substrate, the flexible cable including first circuit paths to convey power, electronic control signals, etc., from the communication equipment to the electronic circuitry on the antenna overlay system, the flexible cable includes second circuit paths to convey data, RF signals, etc., from the electronic circuitry on the antenna overlay system to the communication equipment coupled to the flexible cable.

The ordering of the steps above has been added for clarity sake. Note that any of the processing steps as discussed herein can be performed in any suitable order.

Other embodiments of the present disclosure include software programs and/or respective hardware to perform any of the method embodiment steps and operations summarized above and disclosed in detail below.

It is to be understood that the system, method, apparatus, instructions on computer readable storage media, etc., as discussed herein also can be embodied strictly as a software program, firmware, as a hybrid of software, hardware and/or firmware, or as hardware alone such as within a processor (hardware or software), or within an operating system or a within a software application.

As discussed herein, techniques herein are well suited for use in the field of supporting wireless communications. However, it should be noted that embodiments herein are not limited to use in such applications and that the techniques discussed herein are well suited for other applications as well.

Additionally, note that although each of the different features, techniques, configurations, etc., herein may be discussed in different places of this disclosure, it is intended, where suitable, that each of the concepts can optionally be executed independently of each other or in combination with each other. Accordingly, the one or more present inventions as described herein can be embodied and viewed in many different ways.

Also, note that this preliminary discussion of embodiments herein (BRIEF DESCRIPTION OF EMBODIMENTS) purposefully does not specify every embodiment and/or incrementally novel aspect of the present disclosure or claimed invention(s). Instead, this brief description only presents general embodiments and corresponding points of novelty over conventional techniques. For additional details and/or possible perspectives (permutations) of the invention (s), the reader is directed to the Detailed Description section (which is a summary of embodiments) and corresponding figures of the present disclosure as further discussed below.

Figure 1:
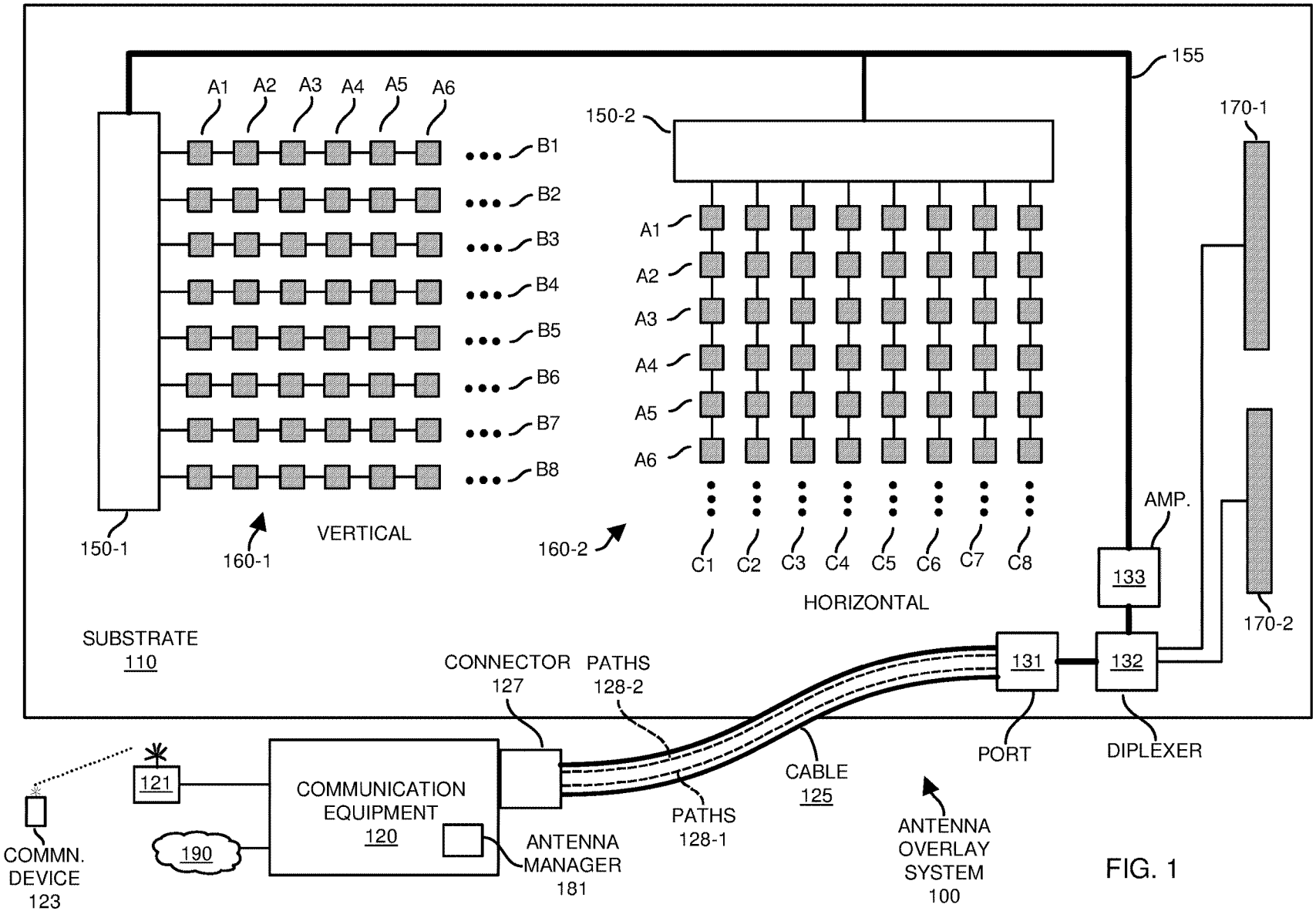
FIG. 1 is an example diagram illustrating a first version of an antenna overlay system (apparatus) according to embodiments herein.

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, etc.

DETAILED DESCRIPTION

As discussed in more detail herein, in one embodiment, an apparatus (antenna overlay system) provides enhanced RF signal reception and transmission. The apparatus includes a substrate. An adhesive layer is disposed on a surface of the substrate to enable coupling or attachment of the antenna overlay system to an object such as a window in a wireless region to be monitored.

In one embodiment, the antenna overlay system (apparatus) further includes components thereon such as antenna hardware, a communication link, and electronic circuitry disposed on the substrate. The communication link couples at least the electronic circuitry to the antenna hardware. During operation, the electronic circuitry controls the antenna hardware on the substrate to transmit and receive wireless signals in a wireless region. A cable conveys communications between the antenna overlay system and a communication device such as customer premises equipment disposed in a subscriber domain in which a respective customer resides.

Now, more specifically, FIG. 1 is an example diagram illustrating an antenna overlay system according to embodiments herein.

As shown, the antenna overlay system 100 (apparatus, device, etc.) includes multiple components (such as antenna hardware 160-1, antenna hardware 160-2, beamforming control circuitry 150-1, beamforming control circuitry 150-2, amplifier circuitry 133, diplexer circuitry 132, port 131) disposed on substrate 110.

In one embodiment, the substrate 110 is fabricated from a polymer material such as acrylic material, laser etched polyimide material, etc., although the substrate 110 can be any suitable material depending on the embodiment.

Note that the antenna elements of the antenna hardware 160 (such as antenna hardware 160-1, antenna hardware 160-2, etc.) can be fabricated in any suitable manner. In one embodiment, the antenna elements of the antenna hardware 160 are printed or painted with LDS paint or other suitable material onto the substrate 110.

In accordance with further embodiments, the substrate 110 is transparent and flexible. In such an instance, the substrate 110 will not prevent a respective person from seeing through a respective window to which the antenna overlay system 100 and substrate 110 is attached.

The flexibility of the substrate 110 enables the antenna overlay system 100 to be attached to any surface such as a window of a building, window of an automobile, flat surface, curved surface, etc. The transparency of substrate 110 (i.e., ability to see through the antenna overlay system 100) aids in the aesthetic integration of antenna elements (antenna hardware 160) into the visual aperture of a respective window, over which the antenna overlay system 100 is adhered by an installer.

As discussed herein, the antenna overlay system 100 provides enhanced RF signal reception and transmission. To provide such functionality, the antenna overlay system 100 further includes antenna hardware 160 (such as multi-dimension antenna array 160-1, multi-dimension antenna array 160-2, etc.).

In this example embodiment, the multi-dimension antenna array 160-1 includes multiple rows and columns of antenna elements (such as patch antenna elements) configured to support reception and transmission of wireless signals at frequencies greater than 8 GHz (GigaHertz). A typical area covered by the antenna elements of antenna hardware 160-1 is 3 by 3 inches, although the size of each patch antenna element and amount of coverage of antenna hardware 160-1 and 160-2 can vary depending upon the embodiment.

As further discussed below, the beamforming control circuitry 150-1 controls reception and transmission of RF signals at any suitable angle via antenna hardware 160. For example, in one embodiment, the beamforming control circuitry receives beamforming control signals from the antenna manager 181 disposed in the communication equipment 120. Note that in accordance with further embodiments, if desired, the antenna manager 181 can be disposed on the substrate 110 or any other suitable location as an alternative to being disposed in the communication equipment 120.

In addition to the antenna hardware 160 providing reception and transmission of wireless signals, the antenna overlay system 100 includes a communication link 155 (such as one or more traces) and electronic circuitry (such as amplifier circuitry 133, diplexer circuitry 132, and port 131) disposed on a surface of the substrate 110.

In one embodiment, in a first direction, from the antenna overlay system 100 to the communication equipment 120, as its name suggests, the amplifier circuitry 133 provides amplification of electrical signals produced by the antenna elements of respective antenna hardware 160. For example, antenna manager controls beamforming circuitry 150. Based on beamforming settings indicated by the antenna manager 181, the antenna elements of the antenna hardware 160-1 generate an electrical signal sensed or detected by the beamforming control circuitry 150-1. Beamforming control circuitry 150-1 transmits the signal over communication link 155 to the amplifier circuitry 133. Amplifier circuitry 133 amplifies the received RF signal to produce an amplified signal communicated to the diplexer circuitry 132.

Diplexer circuitry 132 multiplexes and conveys the received RF signal (such as received from antenna hardware 160 or antenna hardware 170) to port 131 and flexible cable 125 to the communication equipment 120 (which, as shown, is disparately located with respect to the antenna overlay system 100).

Thus, the beamforming circuitry 150 on the substrate 110 converts the received wireless signal (from antenna hardware 160) into a corresponding electrical that is amplified and conveyed over the flexible cable 125 to the communication equipment 120. The communication equipment 125 can be configured to include appropriate circuitry to demodulate the received RF electrical signal for further communication of messages, data, etc., to an appropriate target resource in the subscriber domain that it serves.

Note that, in one embodiment, the electronic circuitry on the substrate 110 can be configured to include a demodulator that is operable to demodulate the received signal to remove the carrier frequency and forward the demodulated signal over the flexible cable 125 to the communication equipment 120.

In accordance with further embodiments, in a second direction, such as from the communication equipment 120 to the antenna overlay system 100, the flexible cable 125 can be configured to convey an RF signal generated by the communication equipment (or other suitable resource) to the electronic circuitry disposed on the substrate 110 to launch a respective one or more wireless RF signals from the antenna hardware 160-1 at any of one or more desired carrier frequencies.

For example, in one embodiment, the amplifier circuitry 133 can be configured to amplify a received electrical signal(s) received over the flexible cable 125 and communicates the amplified RF signals to the beamforming control circuitry 150-1 that appropriately drives the antenna elements of a respective antenna array of antenna hardware 160-1 or 160-2 (or both) to launch the received electrical signal as a wireless RF signal to a remote communication device.

Note again that the communication equipment 120 (for example, customer premises equipment such as modem) can be configured to include the antenna manager 181. In one embodiment, the antenna manager 181 generates beamforming control signals communicated through the cable 125 and communication link 155 to the appropriate beamforming control circuitry 150 (such as beamforming control circuitry 150-1 and beamforming control circuitry 150-2).

As previously discussed, the beamforming control circuitry 150 uses the received beamforming control signals to determine one or more directions of receiving wireless signals in the monitored region as well as transmitting wireless signals in the monitored region. In the latter instance of transmitting wireless signals, in addition to generating the beamforming control signals to control a direction of transmitting wireless signals, the communication equipment 120 can be configured to generate a respective RF signal (including data, messages, etc., that is conveyed over cable 125 and communication link 155 to the beamforming control circuitry 150) to be launched from respective antenna hardware 160 as a wireless signal.

Thus, in accordance with certain embodiments, the antenna overlay system 100 includes a flexible cable 125 coupling, via one or more first circuit paths 128-1, electronic circuitry on the substrate 110 to communication equipment 120 disparately located with respect to the substrate 110. One or more second circuit paths 128-2 of the flexible cable 125 are operable to convey, in a reverse direction, beamforming control signals, RF signals, etc., from the communication equipment 120 (antenna manager 181) or other controller resource to the respective beamforming control circuitry 150 in communication with the antenna hardware. In such an instance, the beamforming control signals control beamforming of transmitting and receiving wireless signals with respect to the antenna hardware 160 disposed on the substrate.

Note that the antenna hardware 160-1 and 160-2 disposed on the substrate 110 can be configured to support any suitable wireless RF carrier frequencies. For example, in one non-limiting example embodiment, the antenna hardware 160-1 disposed on the substrate 110 is sized and configured to support reception and transmission of wireless signals at carrier frequencies of greater than 8 GHz. In accordance with further embodiments, the antenna hardware 170-1 and 170-2 supports transmission and reception of RF energy (such as based on 5G wireless technology) at so-called millimeter wavelengths.

In one example embodiment, the first antenna hardware 160 and second antenna hardware 170 disposed on the substrate 110 support any suitable RF carrier frequencies. For example, in one non-limiting example embodiment, the first antenna hardware 160 is operable to transmit/receive first wireless signals at carrier frequencies greater than 8 GHz (such as 5G wireless signals), the second antenna hardware 170 is operable to transmit/receive second wireless signals such as LTE (Long Term Evolution) signals at carrier frequencies below 8 GHz.

In one embodiment, the flexible cable 125 includes one or more circuit paths to convey the greater than 8 GHz electrical signals (produced by the antenna hardware 160 receiving the greater than 8 GHz wireless signals) to the communication equipment 120 for processing. In a reverse direction, the flexible cable 125 includes one or more circuit paths to convey greater than 8 GHz electrical signals (produced by the communication equipment 120) from the communication equipment 120 to the antenna hardware 160 for launching from the antenna hardware 160 as respective (greater than 8 GHz) wireless RF signals.

In a similar manner, the flexible cable 125 includes one or more circuit paths to convey the less than 8 GHz electrical signals (produced by the antenna hardware 170 receiving the less than 8 GHz wireless signals) to the communication equipment 120 for processing. In a reverse direction, the flexible cable 125 includes one or more circuit paths to convey less than 8 GHz electrical signals (produced by the communication equipment 120) from the communication equipment 120 to the antenna hardware 170 for launching from the antenna hardware 170 as respective (less than 8 GHz) wireless RF signals.

Diplexer 132 controls which set of antenna hardware (such as antenna hardware 160 or antenna hardware 170) is used to transmit and receive wireless signals from the antenna overlay system 100. Communication equipment 120 and/or antenna manager 181 can be configured to generate one or more control signals over the further comprising 125 to the diplexer to control which antenna hardware is used to receive and transmit wireless signals.

As further discussed below in FIG. 2, the antenna hardware 160 can include any number of ports and respective arrays of antenna elements to support diversity. In this example embodiment, the antenna overlay system 100 of FIG. 2 includes: a first port (PORT 1) having a first multiple-dimensional antenna array 160-1 for vertical beamforming and a second multiple-dimensional antenna array 160-2 for horizontal beamforming as well as a second port (PORT 2) having a first multiple-dimensional antenna array 160-4 for vertical beamforming and a second multiple-dimensional antenna array 160-3 for horizontal beamforming.

Referring again to FIG. 1, embodiments herein include a cable 125 (rigid or flexible) coupled to the electronic circuitry components disposed on the substrate 110. The cable 125 can be configured to include any number of circuit paths (traces, wires, etc.).

In one embodiment, a first set of circuit paths 128-1 of the cable 125 are operable to convey power (such as one or more voltages) to the electronic circuitry (such as diplexer circuitry 132, amplifier circuitry 133, beamforming control circuitry 150, etc.) disposed on the substrate 110.

The communication equipment 120 can be configured to include a power supply system that produces or supplies the one or more voltages conveyed over the flexible cable 125 to power the electronic circuitry disposed on the substrate 110. Thus, in one embodiment, the power supply (such as disposed in the communication equipment 120) powering the electronic circuitry disposed on the substrate 110 is disparately located with respect to the antenna overlay system 100 and corresponding substrate 110.

In accordance with further embodiments, the flexible cable 125 can be configured to include a second set of circuit paths to convey one or more signals of data from the electronic circuitry to (off-substrate) communication equipment 120 coupled to the flexible cable 125 via connector 127.

Thus, in one embodiment, the communication equipment 120 supplies power from one or more respective power supplies in the communication equipment 120 (or other suitable resource) over one or more first circuit paths of flexible cable 125 to the antenna overlay system 110; the flexible cable 125 also conveys, via second circuit paths 128-2, communications from the antenna overlay system 100 to the communication equipment 120 as well as conveys communications from the communication equipment 120 to the antenna overlay system 100.

In one embodiment, the high antenna array-gain provided by each of antenna hardware 160-1, 160-2, etc., and amplifier circuitry compensates for any wireless signal losses (attenuation such as 20-26 dB) caused by low-E glass, object interference, etc.

Figure 2:
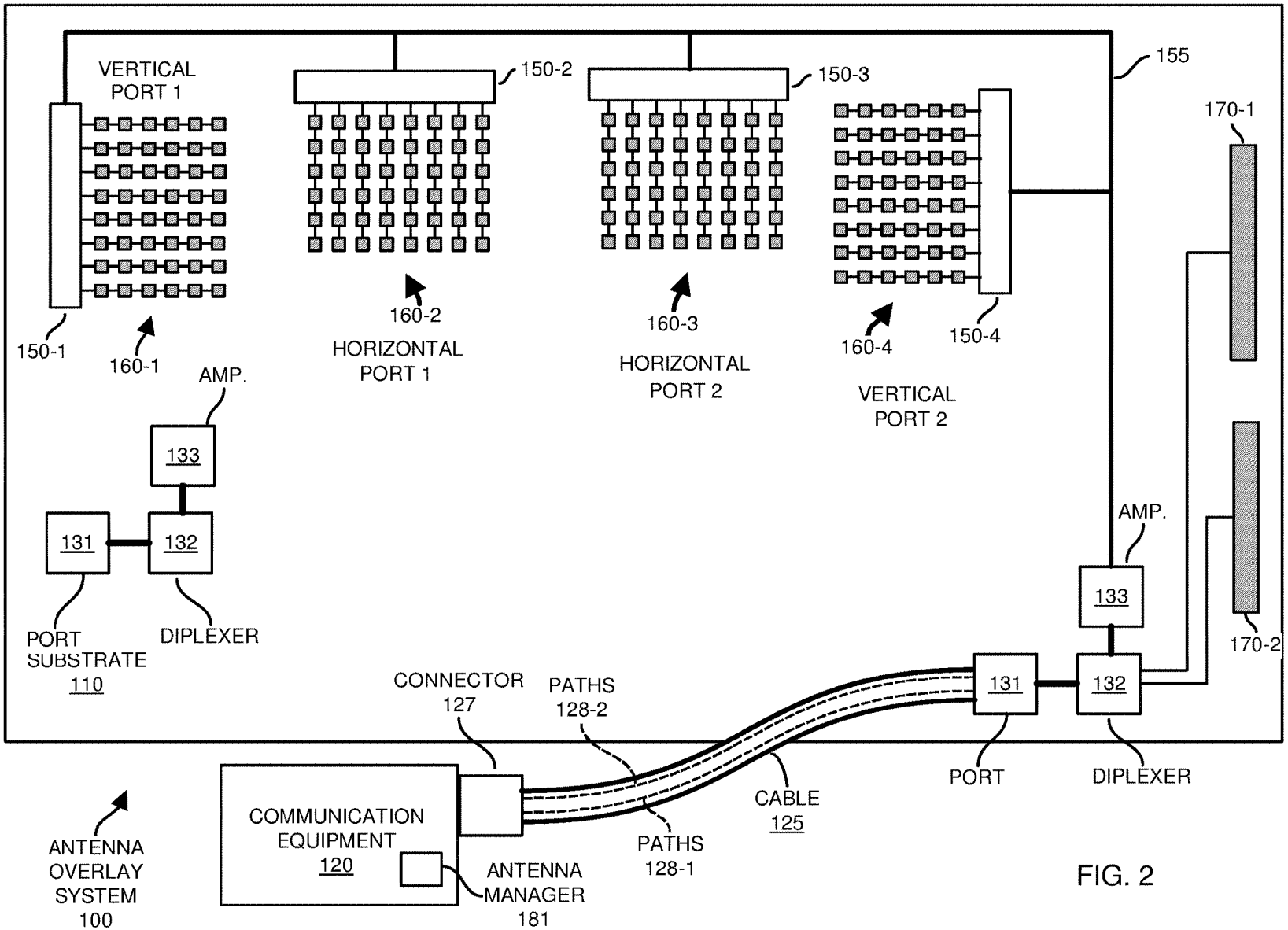
FIG. 2 is an example diagram illustrating a second version of an antenna overlay system (apparatus) according to embodiments herein.

With further reference to FIG. 2, the antenna hardware 160 disposed on the substrate 110 includes first antenna hardware 160-1 such as a first multi-dimensional array of multiple antenna elements (antenna hardware 160-1) supporting vertical beam-forming in a monitored wireless region; the antenna hardware 160 includes second multi-dimensional array (antenna hardware 160-2) of multiple antenna elements supporting horizontal beam-forming in the monitored wireless region.

The antenna hardware 160 disposed on the substrate 110 further includes second antenna hardware such as a multi-dimensional array of multiple antenna elements (antenna hardware 160-4) supporting vertical beam-forming in the monitored wireless region; the antenna hardware 160 includes second multi-dimensional array (antenna hardware 160-3) of multiple antenna elements supporting horizontal beam-forming in the wireless region.

The use of i) a first port (PORT #1) including multiple antenna arrays 160-1 (such as a vertical steering millimeter wave array) and 160-2 (such as a horizontal steering millimeter wave array), and ii) a second port (PORT #2) including multiple antenna arrays 160-4 (such as a vertical steering millimeter wave array) and 160-3 (such as a horizontal steering millimeter wave array) provides diversity and enables better reception and transmission of wireless signals than conventional antenna hardware.

Figure 3:
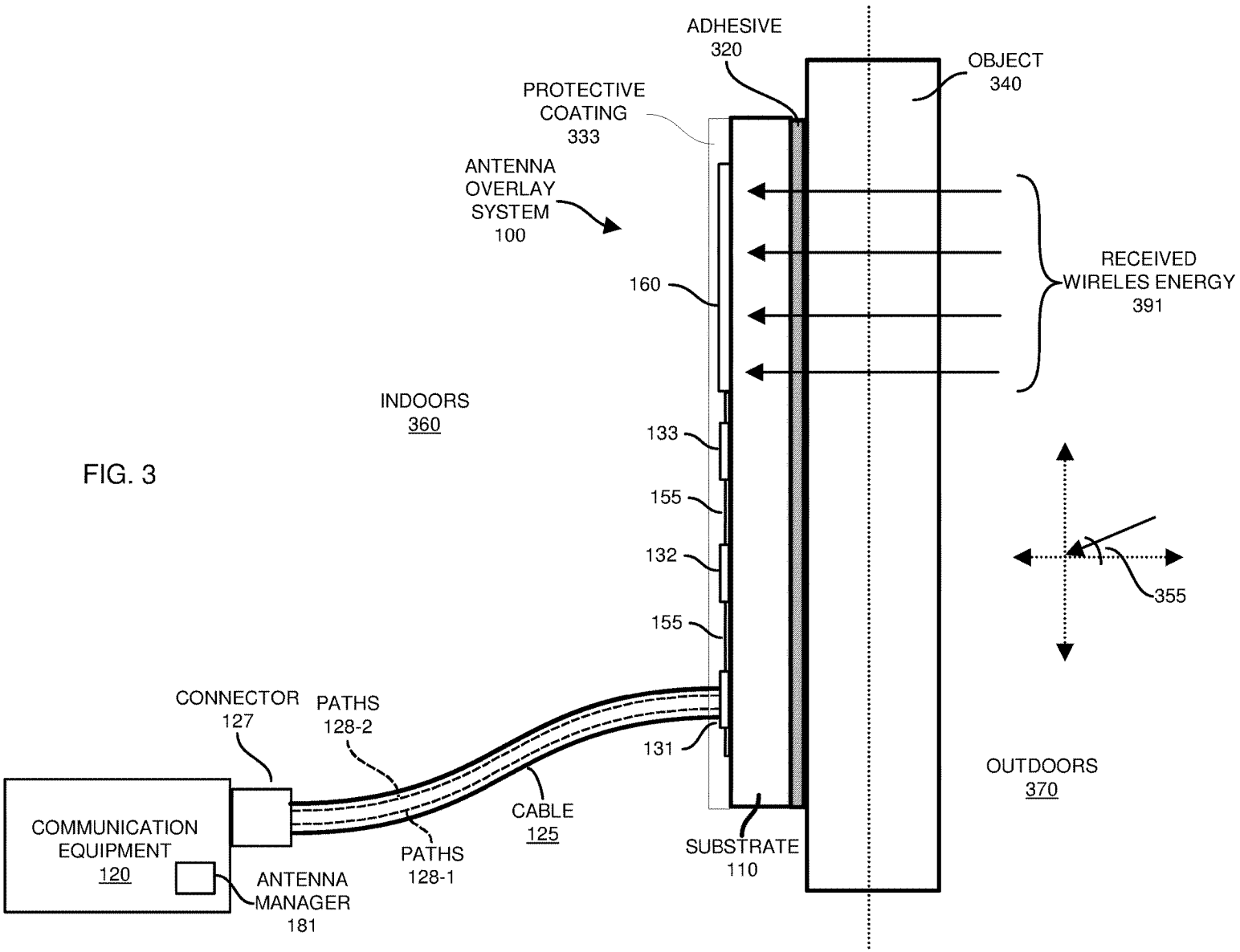
FIG. 3 is an example diagram illustrating reception of RF energy using an antenna overlay system disposed on an indoor surface according to embodiments herein.

FIG. 3 is an example diagram illustrating reception of RF energy using an antenna overlay system disposed on an indoor surface of a building according to embodiments herein.

As shown in this example embodiment, the antenna overlay system 100 further includes an adhesive 320 layer of material disposed on a surface of the substrate 110 to attach the antenna overlay system 100 to an object 340 such as a window (glass, screen, etc.). In this example embodiment, the antenna overlay system 100 is attached via the adhesive 320 to an indoor surface of the object 340.

If desired, the antenna overlay system 100 includes a protective (transparent) coating 333 to prevent the components on the substrate 110 from being damaged.

In one embodiment, the object 340 is part of a low-E glass window that substantially attenuates wireless signals 391 from being received by communication equipment 120 disposed indoors 360 such as in a building or room in which the windowpane (object 340) is installed.

As further shown, the antenna hardware 160 receives the wireless energy 391 through at least the object 340. Based on the received wireless energy 391, the antenna hardware 160 generates a respective electrical signal as previously discussed. Via communication link 155, the beamforming control circuitry 150 communicates the respective electrical signal to the amplifier circuitry 133. The amplifier circuitry 133 amplifies the RF electrical signal and communicates it over communication link 155 to the diplexer circuitry 132. The diplexer circuitry 132 multiplexes amplified signal and forwards it though the port 131 and flexible cable 125 to the communication equipment 120.

In one embodiment, the signal conveyed over the flexible cable 125 is encoded in accordance with an Ethernet protocol (or other suitable protocol) readily processed, forwarded, and/or handled by the communication equipment 120.

As previously discussed, the beamforming control circuitry 150 can receive control signals from the antenna manager 181 indicating one or more directions (angles 355) in which to receive wireless signals 391. Beamforming supports receiving and transmitting wireless signals in any suitable direction.

In one embodiment, the antenna manager 181 produces beamforming control signals to the beamforming control circuitry 150 to scan at different angles to detect from which one or more directions while the wireless energy 391 is received. Based on receipt of (scan) control signals from a beamforming management resource (antenna manager 181), the beamforming control circuitry 150 is operable to: i) scan the outdoors 370 wireless region for receipt of a first wireless signal.

Figure 4:
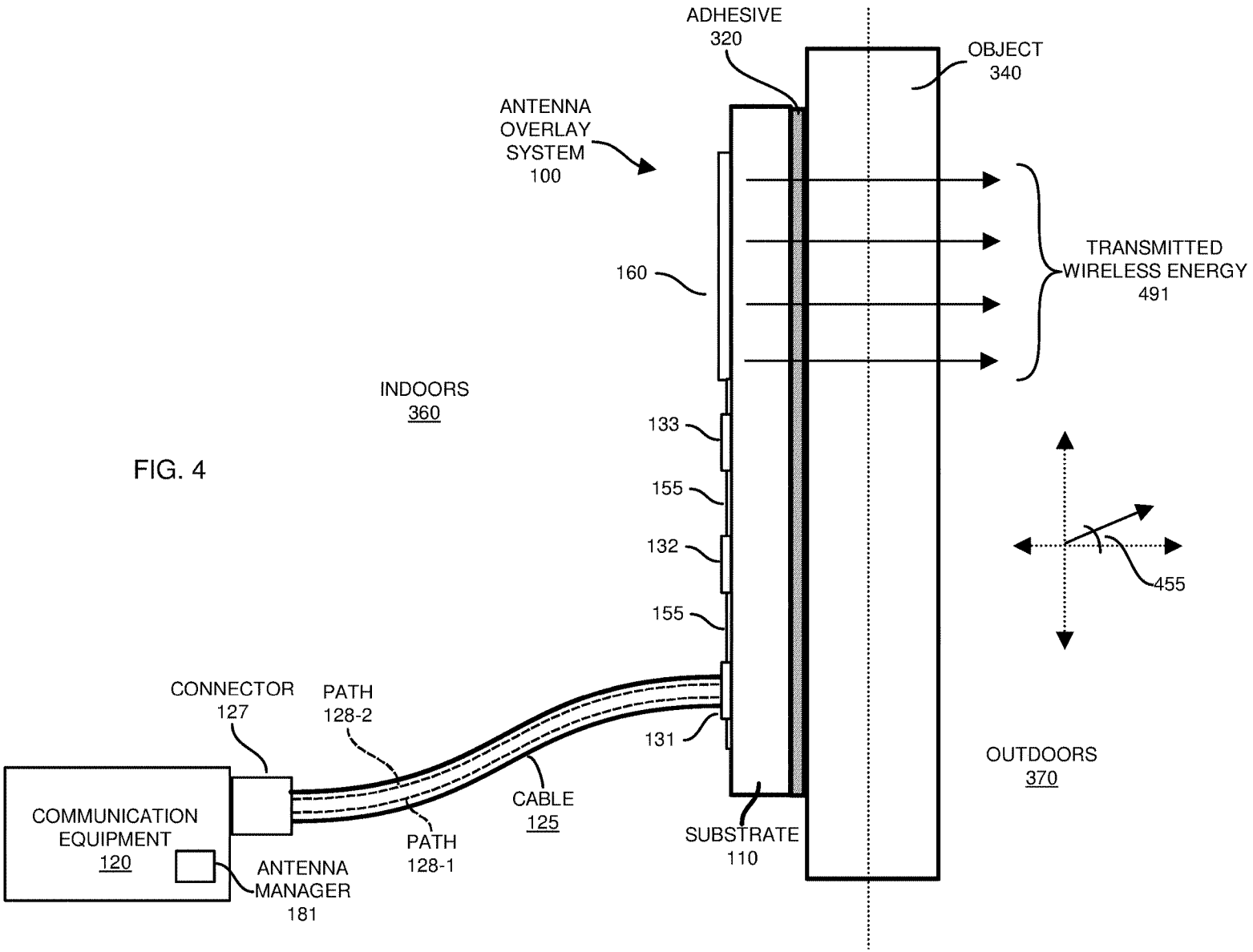
FIG. 4 is an example diagram illustrating transmission of RF energy from an antenna overlay system disposed on an indoor surface according to embodiments herein.

In one embodiment, once it is known from which direction the received wireless energy 391 is received, the antenna manager 181 can be configured to control the direction from which corresponding wireless energy is transmitted from the antenna hardware 160 as discussed in FIG. 4. In one embodiment, as shown in FIG. 4, the antenna manager 181 generates beamforming control signals to the beamforming control circuit 150 to transmit second wireless energy 491 (in a reverse direction) but at a same angle from which the wireless energy 391 was received in FIG. 3.

FIG. 4 is an example diagram illustrating transmission of RF energy from an antenna overlay system disposed on an indoor surface according to embodiments herein.

As shown in this example embodiment, the communication equipment 120 (or other suitable resource) generates a corresponding RF signal to be wirelessly transmitted as wireless energy 491 from the antenna hardware 160.

In one embodiment, as previously discussed, the antenna manager 181 generates respective beamforming control signals communicated to the beamforming control circuitry 150. The beamforming control circuitry 150 uses the beamforming control signals generated by the antenna manager 181 to launch the wireless energy 491 at an appropriate one or more angles to one or more respective target communication devices.

In one embodiment, the antenna manager 181 control the antenna hardware 160 to scan a wireless region for wireless signals (energy 391) of interest such as those directed to a particular one or more communication devices (such as communication equipment 120, communication device, communication device 123, etc.) disposed in the room or building in which the communication equipment 120 resides. Based on the identified one or more angles from which one or more signals (energy 391) of interest are received, the communication equipment 120 and/or antenna manager 181 can be configured to initiate communications (via transmitted wireless energy 491) in a same one or more angles to the devices generating the received wireless energy 391.

Thus, if desired, the antenna manager 181 can be configured to control beamforming of antenna hardware to receive communications from multiple devices (such as at a first angle, second angle, etc.) and communicate in a reverse direction (such as at the first angle, second angle, etc.) to each of the multiple devices from which RF energy was received.

Figure 5:
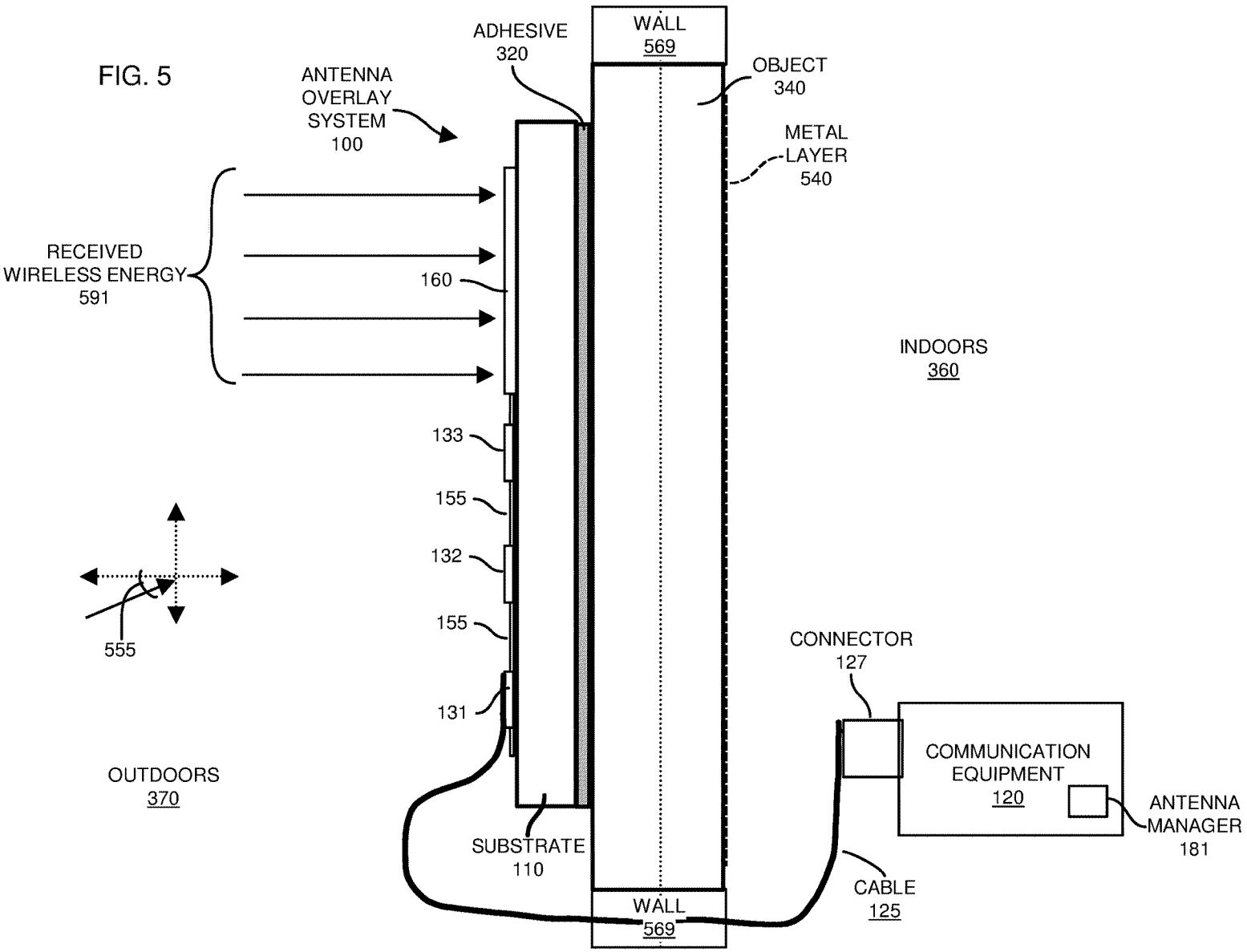
FIG. 5 is an example diagram illustrating reception of RF energy using an antenna overlay system disposed on an outdoor surface according to embodiments herein.

FIG. 5 is an example diagram illustrating reception of RF energy at an antenna overlay system disposed on an outdoor surface of an object such as a window according to embodiments herein.

In this example embodiment, the antenna overlay system 100 is disposed outdoors 370 on an exterior surface of object 340. Metal layer 540 (such as low E glass) is present on object 340 to reduce heat transfer from indoors 360 to outdoors 370 and vice versa.

The antenna overlay system 100 in this example embodiment operates in a similar manner as previously discussed. However, in this example embodiment, the flexible cable 125 passes through a wall 569 or crack between the object 340 (such as a window) and wall 569 to provide connectivity between the antenna overlay system 100 and the communication equipment 120.

In a similar manner as previously discussed, the antenna hardware 160 receives the wireless energy 591 from one or more remote communication devices. The wireless RF energy 691 is converted (via the antenna overlay system 100) to an appropriate RF signal and conveyed (from outdoors 370 to indoors 360) over the flexible cable 125 to the communication equipment 120.

Figure 6:
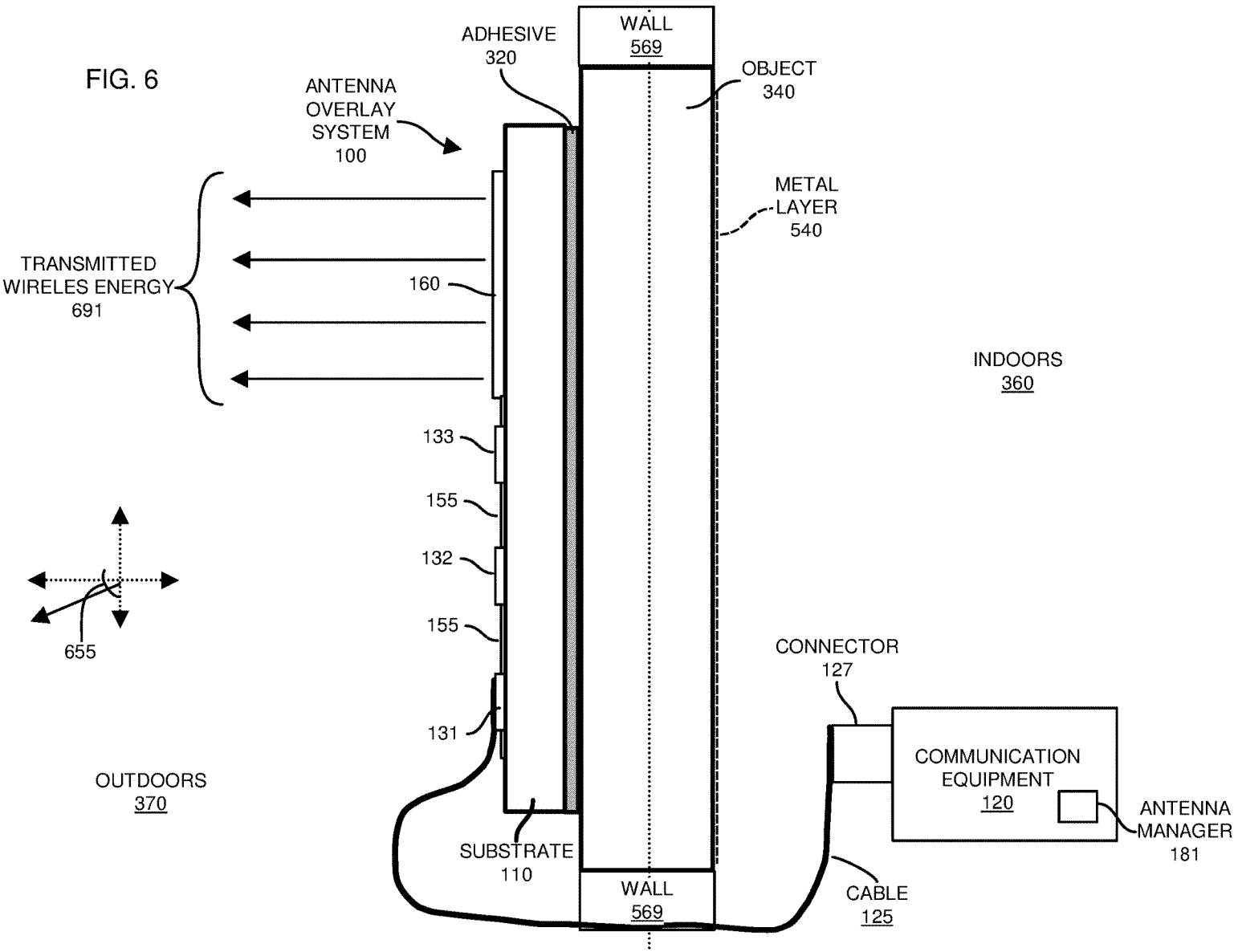
FIG. 6 is an example diagram illustrating transmission of RF energy using an antenna overlay system disposed on an outdoor surface according to embodiments herein.

FIG. 6 is an example diagram illustrating transmission of RF energy from an antenna overlay system disposed on an outdoor surface of an object such as a window according to embodiments herein.

In this example embodiment, the antenna overlay system 100 is disposed outdoors 370 on an exterior surface of object 340. Metal layer 540 (such as low E glass) is present on object 340 to reduce heat loss.

The antenna overlay system 100 in this example embodiment operates in a similar manner as previously discussed. However, in this example embodiment, the flexible cable 125 passes through a wall 569 or crack between the object 340 (window) and wall 569 to provide connectivity between the antenna overlay system 100 and the communication equipment 120.

In a similar manner as previously discussed, the communication equipment 120 generates and transmits an RF signal (from indoors 360 to outdoors 370) over flexible cable 125 to electronic circuitry disposed on substrate 110. The antenna overlay system 100 (and corresponding electronic circuitry) conveys, amplifies and/or modulates the received RF signal to output the RF signal from the communication equipment 120 as wireless energy 691 from the antenna hardware 160 to one or more target recipients.

Figure 7:
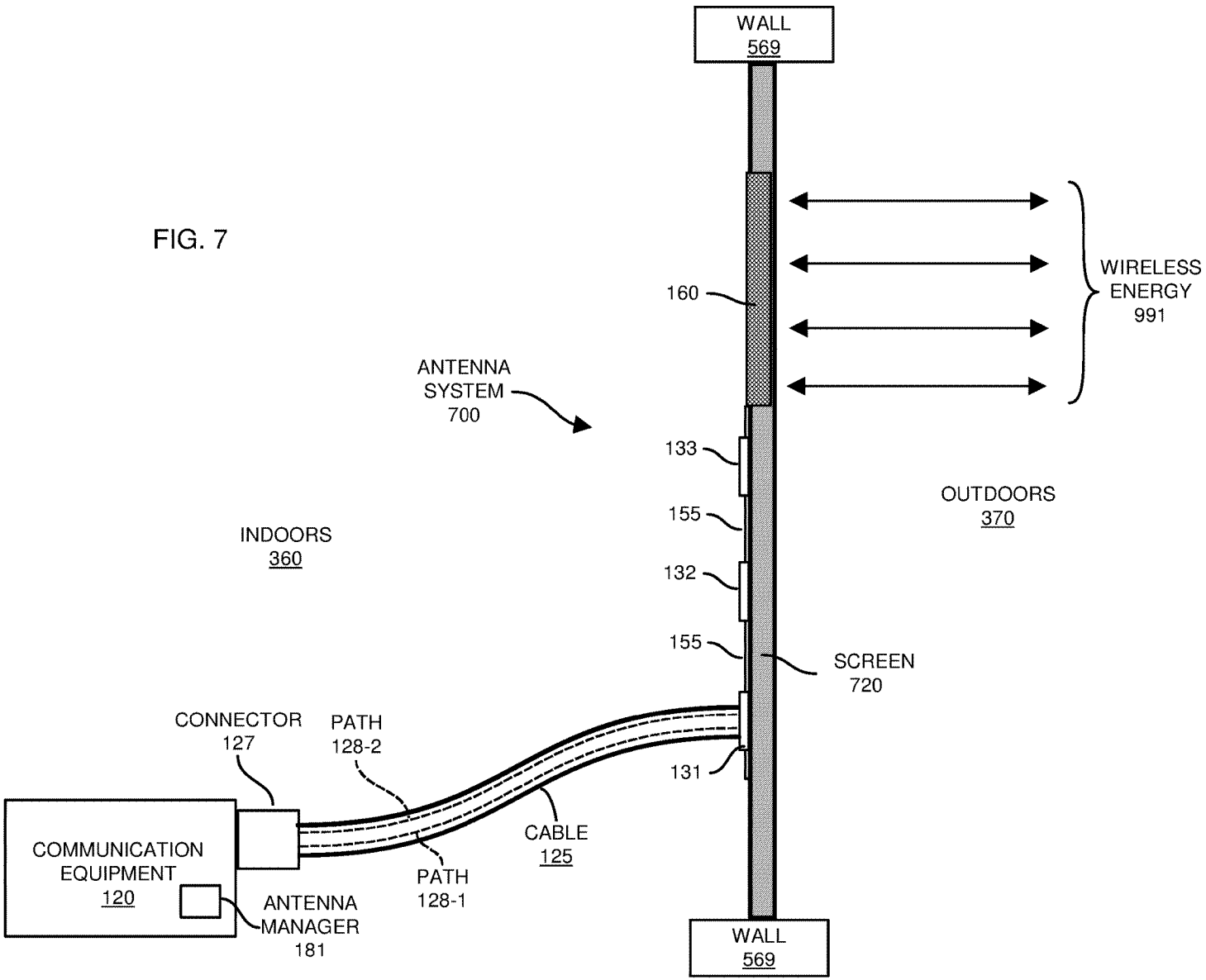
FIG. 7 is an example diagram illustrating transmission and reception of RF energy using an antenna overlay system according to embodiments herein.

FIG. 7 is an example diagram illustrating transmission and reception of RF energy using an antenna system according to embodiments herein.

In this example embodiment, the antenna hardware 160 is disposed in a substrate such as a screen 720. In one embodiment, the screen is a mesh through which air is able to pass from indoors 360 to outdoors 370 and vice versa.

During operation, as shown, the antenna hardware 160 of antenna system 700 is operable to receive and transmit wireless energy 991 via the antenna hardware 160 disposed in or on screen 720 in a similar manner as previously discussed.

Figure 8:
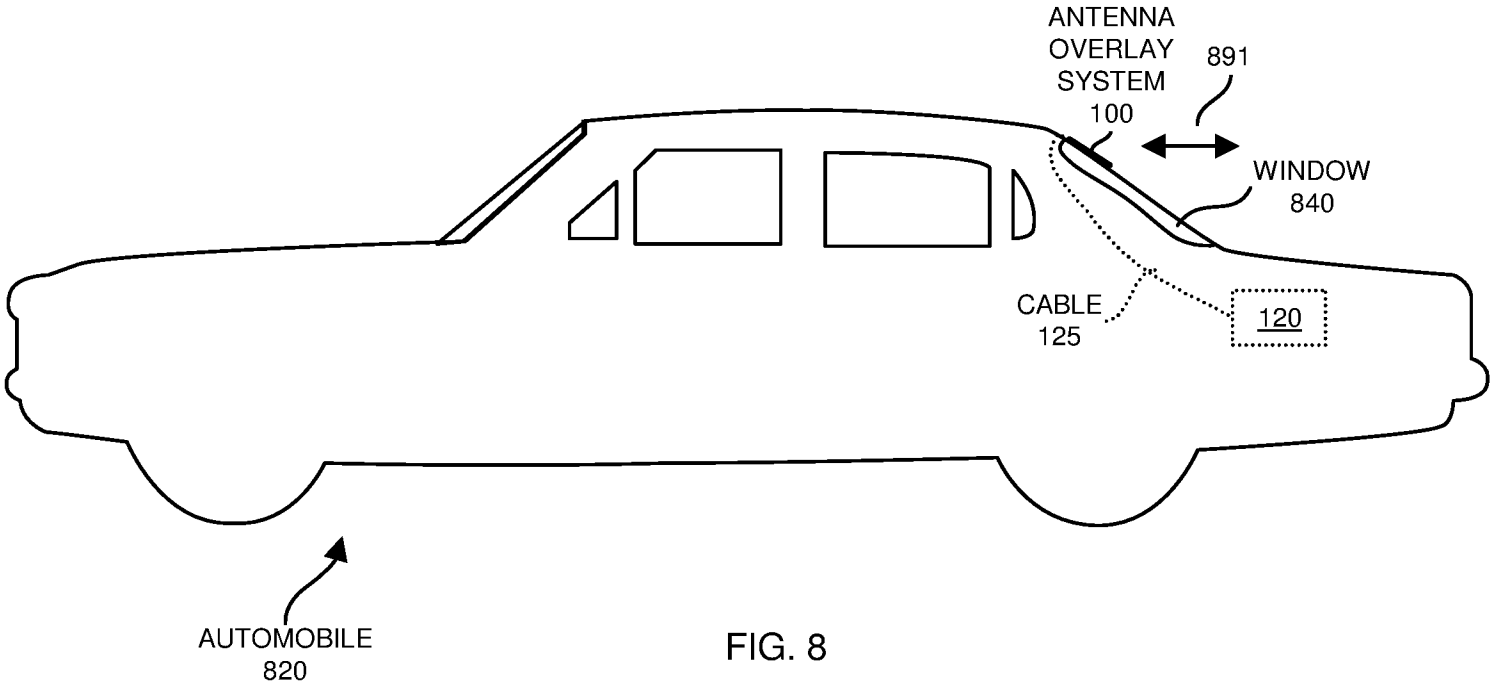
FIG. 8 is an example diagram illustrating transmission and reception of RF energy using an antenna overlay system according to embodiments herein.

FIG. 8 is an example diagram illustrating transmission and reception of RF energy using an antenna overlay system according to embodiments herein.

In this example embodiment, the antenna overlay system 100 is disposed on a window 840 or screen of an automobile 820. During operation, as shown, the antenna overlay system 100 is operable to receive and transmit wireless energy 891 in a similar manner as previously discussed.

Figure 9:
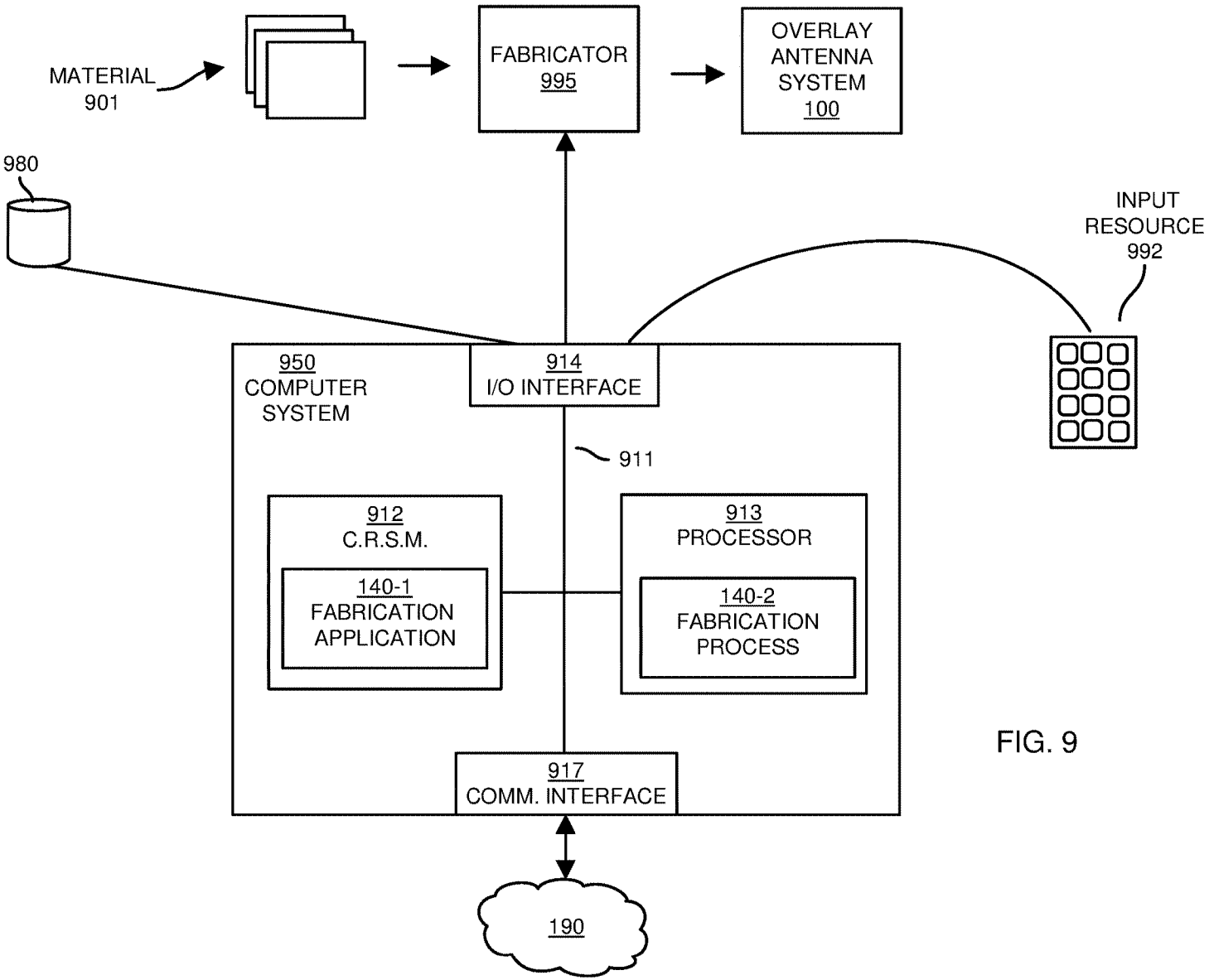
FIG. 9 is an example diagram illustrating example computer architecture operable to execute one or more operations according to embodiments herein.

FIG. 9 is an example block diagram of a computer system for implementing any of the operations as previously discussed according to embodiments herein.

Any of the resources (such as communication equipment 120, antenna manager 181, fabricator 995, etc.) as discussed herein can be configured to include computer processor hardware, analog/digital circuitry, and/or corresponding executable instructions to carry out the different operations as discussed herein.

As shown, computer system 950 of the present example includes an interconnect 911 that couples computer readable storage media 912 such as a non-transitory type of media (i.e., any type of hardware storage medium) in which digital information can be stored and retrieved, a processor 913, I/O interface 914, and a communications interface 917.

I/O interface(s) 914 supports connectivity to repository 980 and input resource 992.

Computer readable storage medium 912 can be any hardware storage device such as memory, optical storage, hard drive, floppy disk, etc. In one embodiment, the computer readable storage medium 912 stores instructions and/or data.

As shown, computer readable storage media 912 can be encoded with fabrication (management) application 140-1 (e.g., including instructions) to carry out any of the operations as discussed herein.

During operation of one embodiment, processor 913 accesses computer readable storage media 912 via the use of interconnect 911 in order to launch, run, execute, interpret or otherwise perform the instructions in fabrication (management) application 140-1 stored on computer readable storage medium 912. Execution of the fabrication application 140-1 produces fabrication process 140-2 to carry out any of the operations and/or processes as discussed herein.

Those skilled in the art will understand that the computer system 950 can include other processes and/or software and hardware components, such as an operating system that controls allocation and use of hardware resources to fabrication application 140-1.

In accordance with different embodiments, note that computer system 950 may reside in any of various types of devices, including, but not limited to, fabrication equipment, a personal computer system, a wireless device, a wireless access point, a base station, phone device, desktop computer, laptop, notebook, netbook computer, mainframe computer system, handheld computer, workstation, network computer, application server, storage device, a consumer electronics device such as a camera, camcorder, set top box, mobile device, video game console, handheld video game device, a peripheral device such as a switch, modem, router, set-top box, content management device, handheld remote control device, any type of computing or electronic device, etc. The computer system 950 may reside at any location or can be included in any suitable resource in any network environment to implement functionality as discussed herein.

Functionality supported by the different resources will now be discussed via the flowchart in FIG. 10. Note that the steps in the flowcharts below can be executed in any suitable order.

Figure 10:
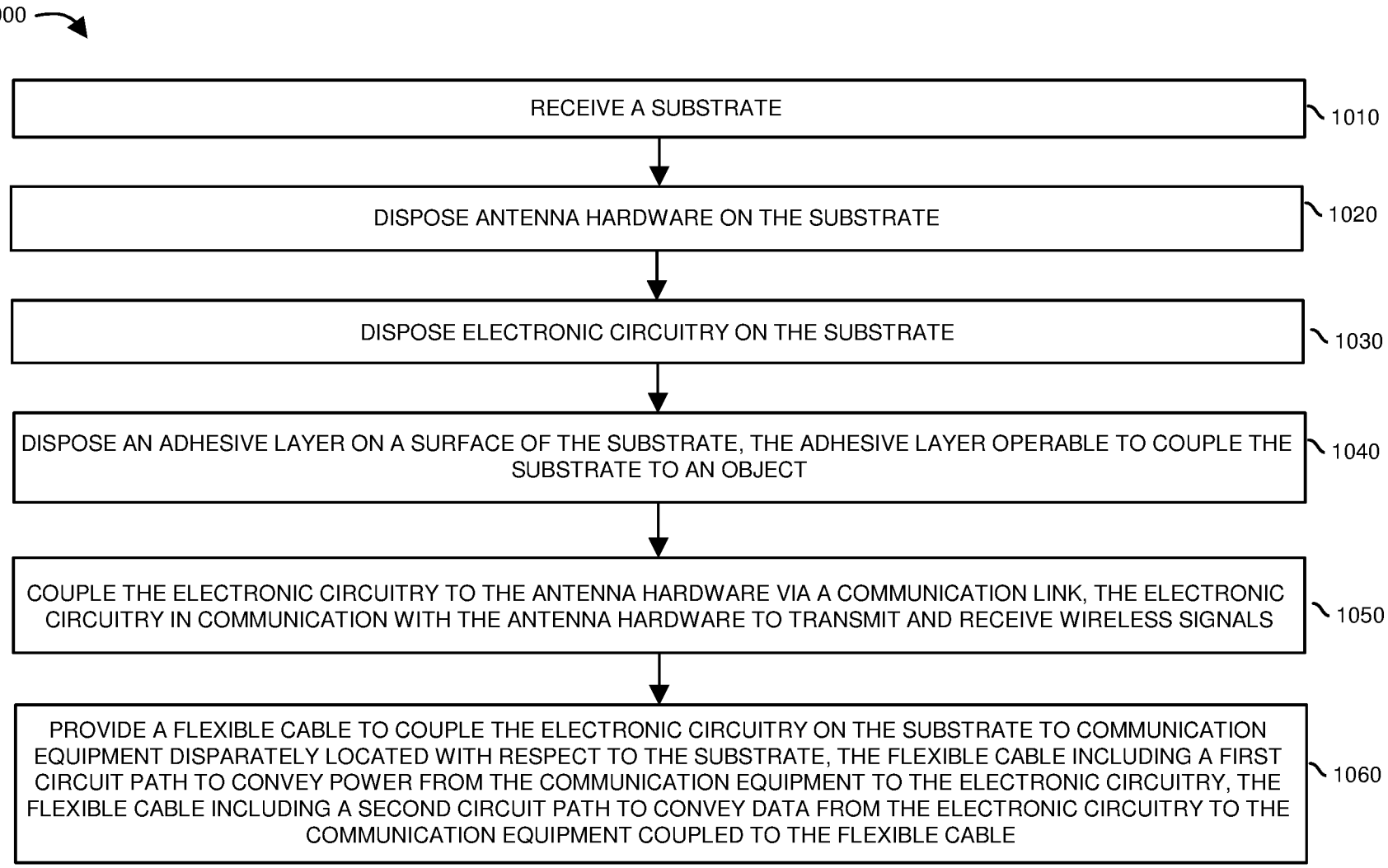
FIG. 10 is an example diagrams illustrating a method of fabricating an antenna overlay system according to embodiments herein.

FIG. 10 is a flowchart 1000 illustrating an example method of fabricating an apparatus according to embodiments herein. Note that there will be some overlap with respect to concepts as discussed above.

In processing operation 1010, the fabricator 995 receives a substrate 110 or fabricates substrate 110 from one or more materials 901.

In processing operation 1020, the fabricator 995 disposes antenna hardware 160 on the substrate 110.

In processing operation 100, the fabricator 995 disposes electronic circuitry (such as beamforming circuitry 150-1, beamforming circuitry 150-2, antenna hardware 160-1, antenna hardware 160-2, amplifier circuitry 133; diplexer circuitry 132, etc.) on the substrate 110.

In processing operation 1040, the fabricator 995 disposes an adhesive 320 layer of material on a respective exposed surface of the substrate 110. As previously discussed, the adhesive layer is operable to couple the substrate 110 to an object 340 such as a window, glass, screen, etc.

In processing operation 1050, the fabricator 995 couples the electronic circuitry (such as diplexer circuitry 132, amplifier circuitry 133, beamforming circuitry 150) to the antenna hardware via a communication link 155.

In processing operation 1060, the fabricator 995 provides a flexible cable 125 to couple the electronic circuitry on the substrate 110 to communication equipment 120 disparately located with respect to the antenna overlay system 100. In one embodiment, the flexible cable 125 includes first circuit paths 128-1 to convey power from the communication equipment 120 to the electronic circuitry (such as diplexer circuitry 132, amplifier circuitry 133, beamforming circuitry 150, etc.). The flexible cable 125 includes second circuit paths 128-2 to convey data and/or signals from the electronic circuitry (such as beamforming circuitry 150, amplifier 133, diplexer 132, etc.) to the communication equipment 120 coupled to the flexible cable 125.

Note again that techniques herein are well suited to provide improved use of wireless bandwidth via enhanced reception and transmission of signals using an antenna overlay system. However, it should be noted that embodiments herein are not limited to use in such applications and that the techniques discussed herein are well suited for other applications as well.

Based on the description set forth herein, numerous specific details have been set forth to provide a thorough understanding of claimed subject matter. However, it will be understood by those skilled in the art that claimed subject matter may be practiced without these specific details. In other instances, methods, apparatuses, systems, etc., that would be known by one of ordinary skill have not been described in detail so as not to obscure claimed subject matter. Some portions of the detailed description have been presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm as described herein, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has been convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a computing platform, such as a computer or a similar electronic computing device, that manipulates or transforms data represented as physical electronic or magnetic quantities within memories, registers, or other information storage devices, transmission devices, or display devices of the computing platform.

While this invention has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting. Rather, any limitations to the invention are presented in the following claims.

We claim:

1. An apparatus comprising:

a substrate;

antenna hardware disposed on the substrate;

a communication link disposed on the substrate; and electronic circuitry disposed on the substrate, the electronic circuitry coupled to the antenna hardware via the communication link, the electronic circuitry in communication with the antenna hardware and operable to transmit and receive wireless signals in a wireless region;

wherein the antenna hardware includes a first multi-dimensional array of multiple antenna elements supporting vertical beam-forming in the wireless region; and wherein the antenna hardware includes a second multi-dimensional array of multiple antenna elements supporting horizontal beam-forming in the wireless region.

2. The apparatus as in claim 1, wherein the substrate is transparent and flexible, the apparatus further comprising:

an adhesive layer disposed on a surface of the substrate, the adhesive layer operable to couple the substrate to a surface of an object in the wireless region.

3. The apparatus as in claim 1, wherein the antenna hardware includes an array of multiple antenna elements; and wherein the electronic circuitry is operable to: i) scan the wireless region for receipt of a first wireless signal, and ii) transmit a second wireless signal, the wireless signal transmitted in a direction from which the first wireless signal is received.

4. The apparatus as in claim 3 further comprising:

a flexible cable coupling the electronic circuitry on the substrate to communication equipment;

wherein the wireless signals include a wireless signal received from the antenna hardware;

wherein the electronic circuitry is operable to convey a RF (Radio Frequency) signal derived from the received wireless signal in the wireless region over a first circuit path of the flexible cable to the communication equipment coupled to the flexible cable; and wherein a second circuit path of the flexible cable is operable to convey beamforming control signals from the communication equipment to the electronic circuitry in communication with the antenna hardware, the beamforming control signals operable to control beamforming of transmitting and receiving the wireless signals.

5. The apparatus as in claim 1, wherein the antenna hardware supports wireless signals at carrier frequencies greater than 8 GHz.

6. The apparatus as in claim 1, wherein the antenna hardware is first antenna hardware disposed on the substrate, the apparatus further comprising second antenna hardware disposed on the substrate, the first antenna hardware operable to transmit/receive first wireless signals at carrier frequencies greater than 8 GHz, the second antenna hardware operable to transmit/receive second wireless signals at carrier frequencies below 8 GHz.

7. The apparatus as in claim 6 further comprising:

a diplexer disposed on the substrate, the diplexer controlling which of the first antenna hardware and the second antenna hardware is used to transmit and receive the wireless signals.

8. The apparatus as in claim 1 further comprising:

a flexible cable coupled to the electronic circuitry, the flexible cable including a first circuit path to convey power to the electronic circuitry.

9. The apparatus as in claim 8, wherein the flexible cable includes a second circuit path to convey data from the electronic circuitry to communication equipment coupled to the flexible cable.

10. The apparatus as in claim 9, wherein the electronic circuitry includes:

an amplifier operable to amplify electronic signals generated by the antenna hardware; and processing hardware operable to convey the data as an RF signal over the second circuit path of the flexible cable to the communication equipment.

11. The apparatus as in claim 1, wherein the substrate is adhered to a window; and wherein the wireless signals transmitted between the antenna hardware and a target communication device pass through a combination of the substrate and the window.

12. The apparatus as in claim 1, wherein the substrate is a screen, the screen being a mesh through which air is passable from indoors to outdoors.

13. The apparatus as in claim 1, wherein the first multi-dimensional array of antenna elements includes a first horizontal sequence of antenna elements and a second horizontal sequence of antenna elements disposed on the substrate, the first horizontal sequence being disposed parallel and next to the second horizontal sequence; and wherein the second multi-dimensional array of antenna elements includes a first vertical sequence of antenna elements and a second vertical sequence of antenna elements disposed on the substrate, the first vertical sequence being disposed parallel and next to the second vertical sequence.

14. The apparatus as in claim 13, wherein the first multi-dimensional array supports vertical beamforming;

wherein the second multi-dimensional array supports horizontal beamforming; and wherein a combination of the first multi-dimensional array and the second multi-dimensional array represent a first communication port operable to transmit and receive the wireless signals.

15. The apparatus as in claim 14 further comprising:

a third horizontal sequence of antenna elements and a fourth horizontal sequence of antenna elements disposed on the substrate, the third horizontal sequence being disposed parallel and next to the fourth horizontal sequence, the third horizontal sequence and the fourth horizontal sequence being a third multi-dimensional array disposed on the substrate; and a third vertical sequence of antenna elements and a fourth vertical sequence of antenna elements disposed on the substrate, the third vertical sequence being disposed parallel and next to the fourth vertical sequence, the third vertical sequence and the fourth vertical sequence being a fourth multi-dimensional array disposed on the substrate.

16. The apparatus as in claim 15, wherein a combination of the third multi-dimensional array and the fourth multi-dimensional array represent a second communication port of the substrate, the second communication port operable to transmit and receive the wireless signals.

17. The apparatus as in claim 16, wherein the substrate is a screen, the screen being a mesh through which air is passable from indoors to outdoors.

18. The apparatus as in claim 17, wherein the substrate is adhered to a window; and wherein the wireless signals conveyed between the antenna hardware and a target communication device pass through a combination of both the substrate and the window.

19. The apparatus as in claim 13, wherein a parallel combination of the first horizontal sequence and the second horizontal sequence are disposed orthogonal to a parallel combination of the first vertical sequence and the second vertical sequence.

20. A method comprising:

receiving a substrate;

disposing antenna hardware on the substrate;

disposing electronic circuitry on the substrate; and coupling the electronic circuitry to the antenna hardware via a communication link, the electronic circuitry in communication with the antenna hardware to transmit and receive wireless signals;

wherein disposing the antenna hardware on the substrate includes:

disposing a first multi-dimensional array of multiple antenna elements on the substrate, the first multi-dimensional array supporting vertical beam-forming; and disposing a second multi-dimensional array of multiple antenna elements, the second multi-dimensional array supporting horizontal beam-forming.

21. The method as in claim 20, wherein the substrate is transparent and flexible, the method further comprising:

disposing an adhesive layer on a surface of the substrate, the adhesive layer operable to couple the substrate to an object.

22. The method as in claim 20, wherein the antenna hardware includes an array of multiple antenna elements; and wherein the electronic circuitry is operable to: based on scan control signals received from a controller, i) scan the wireless region for receipt of a first wireless signal, and ii) transmit a second wireless signal, the second wireless signal transmitted in a direction from which the first wireless signal is received.

23. The method as in claim 22 further comprising:

providing a flexible cable to couple the electronic circuitry on the substrate to communication equipment disparately located with respect to the substrate;

wherein the electronic circuitry is operable to convey a RF (Radio Frequency) signal derived from the received wireless signal in the wireless region over a first circuit path of a flexible cable to the communication equipment coupled to the flexible cable; and wherein a second circuit path of the flexible cable is operable to convey beamforming control signals from the communication equipment to the electronic circuitry in communication with the antenna hardware, the beamforming control signals operable to control beamforming of transmitting and receiving the wireless signals.

24. The method as in claim 20, wherein the antenna hardware supports wireless signals at carrier frequencies greater than 8 GHz.

25. The method as in claim 20, wherein the antenna hardware is first antenna hardware; and wherein disposing the antenna hardware includes:

disposing the first antenna hardware and second antenna hardware on the substrate, the first antenna hardware operable to transmit/receive first wireless signals at carrier frequencies greater than 8 GHz, the second antenna hardware operable to transmit/receive second wireless signals at carrier frequencies below 8 GHz.

26. The method as in claim 20 further comprising:

coupling a flexible cable to the electronic circuitry, the flexible cable including a first circuit path to convey power to the electronic circuitry.

27. The method as in claim 26, wherein the flexible cable includes a second circuit path to convey an RF signal from the electronic circuitry to communication equipment coupled to the flexible cable.

28. The method as in claim 27, wherein the electronic circuitry includes:

an amplifier operable to amplify electronic signals generated by the antenna hardware; and processing hardware operable to convey the data as an RF signal over the second circuit path of the flexible cable to the communication equipment.

29. Computer-readable storage hardware having instructions stored thereon, the instructions, when carried out by computer processor hardware, cause the computer processor hardware to:

receive a substrate;

dispose antenna hardware on the substrate, the antenna hardware including: i) a first multi-dimensional array of multiple antenna elements, the first multi-dimensional array supporting vertical beam-forming, and ii) a second multi-dimensional array of multiple antenna elements, the second multi-dimensional array supporting horizontal beam-forming;

dispose electronic circuitry on the substrate;

dispose an adhesive layer on a surface of the substrate, the adhesive layer operable to couple the substrate to an object; and couple the electronic circuitry to the antenna hardware via a communication link, the electronic circuitry in communication with the antenna hardware to transmit and receive wireless signals.

30. The computer-readable storage hardware as in claim 29, wherein the instructions, when carried out by computer processor hardware, further cause the computer processor hardware to:

provide a flexible cable to couple the electronic circuitry on the substrate to communication equipment disparately located with respect to the substrate, the flexible cable including a first circuit path to convey power from the communication equipment to the electronic circuitry, the flexible cable including a second circuit path to convey a signal from the electronic circuitry to the communication equipment coupled to the flexible cable.

* * * * *